US006051772A

United States Patent [19]

Cameron et al.

[11] Patent Number: 6,051,772

[45] Date of Patent: Apr. 18, 2000

[54] METHOD AND APPARATUS FOR EMULATING A FREQUENCY MODULATION DEVICE

[75] Inventors: Charles J. Cameron; Gary M. Catlin, both of San Jose, Calif.

[73] Assignee: Aureal Semiconductor, Inc., Fremont, Calif.

[21] Appl. No.: 08/893,148

[22] Filed: Jul. 15, 1997

[51] Int. Cl.[7] ..... G10H 1/14; G10H 1/40

[52] U.S. Cl. ..... 84/624; 84/635; 84/DIG. 12; 84/DIG. 27

[58] Field of Search ..... 84/624, 659–661, 84/696, 603, DIG. 27, 635, 636, DIG. 12

[56] References Cited

U.S. PATENT DOCUMENTS 5,164,530 11/1992 Iwase ..... 84/624
5,808,221 9/1998 Ashour et al. ..... 84/624 X

OTHER PUBLICATIONS

Yamaha Corporation, YMF262 Application Manual, Catalog No.: LSI–6MF2622, 1988.

*Primary Examiner*—Stanley J. Witkowski
*Attorney, Agent, or Firm*—Ritter, Van Pelt & Yi LLP

[57] ABSTRACT

A system and method are disclosed for emulating a frequency modulation sound chip with minimal hardware and utilizing the excess capacity of current computer systems. In one embodiment, the frequency modulation emulation apparatus includes a frequency modulation emulator suitable to communicate with a computer system. The frequency modulation emulator provides an addressable memory space, substantially similar to an emulated addressable memory space of the emulated frequency modulation sound chip, such that a frequency modulation application implemented on the computer system can communicate with the frequency modulation emulator. The emulator chip receives audio data through the addressable memory space from the frequency modulation application and, the frequency modulation application is unaware that the frequency modulation emulator is receiving the audio data rather than the emulated frequency modulation sound chip. A frequency modulation generator is implemented on the computer system. The frequency modulation generator receives the audio data from the frequency modulation generator. The frequency modulation generator processes the audio data to produce an audio signal in a manner that is substantially similar to the operation of the emulated frequency modulation sound chip. Thus, minimal hardware is used to emulate a frequency modulation sound chip, and utilizing the excess capacity of current computer systems.

27 Claims, 13 Drawing Sheets

40

| | bank 0 (A1 = 0) | | | | | | | | bank 1 (A1 = 1) | | | | | | | |
|---|---|---|---|---|---|---|---|---|---|---|---|---|---|---|---|---|
| address | D7 | D6 | D5 | D4 | D3 | 41 D2 | D1 | D0 | D7 | D6 | D5 | D4 | D3 | D2 | 42 D1 | D0 |
| 01 | LSI TEST 1 | | | | | | | | LSI TEST 2 | | | | | | | |
| 02 | TIMER 1 PRESET 57 | | | | | | | | | | | | | | | |
| 03 | TIMER 2 PRESET 58 | | | | | | | | | | | | | | | |
| 04 | 72 RST | MT1 | MT2 | | | | ST2 | ST1 | | | CONN | | | | | |
| 05 | | | | | | | | | | | | | | | | 69 NEW |
| 08 | | NTS | | | | | | | | | | | | | | |
| 20-25 28-2d 30-35 | AM | VIB | EGT | 77 KSR | 49 MULT | | | | AM | VIB | EGT | 77 KSR | 49 MULT | | | |
| 40-45 48-4d 50-55 | 43 KSL | | 44 TL | | | | | | 43 KSL | | 44 TL | | | | | |
| 60-65 68-6d 70-75 | 35 AR | | | | 36 DR | | | | 35 AR | | | | 36 DR | | | |
| 80-85 88-8d 90-95 | 37 SL | | | | 38 RR | | | | 37 SL | | | | 38 RR | | | |
| a0-a8 | 47 FNUM (L) | | | | | | | | 47 FNUM (L) | | | | | | | |
| b0-b8 | | | 46 KON | 48 BLK | | | 47 FNUM(H) | | | | 46 KON | 48 BLK | | | 47 FNUM(H) | |
| bd | DAM | DVB | 55 RHY | 56 BD | 57 SD | 52 TOM | 53 TC | 54 HH | | | | | | | | |
| c0-c8 | EX1 | EX0 | 75 STL | 76 STR | 50 FB | | | CNT | EX1 | EX0 | 75 STL | 76 STR | 50 FB | | | CNT |
| e0-e5 e8-ed f0-f5 | | | | | | WS | | | | | | | | WS | | |

| | | | | | | | |
|---|---|---|---|---|---|---|---|
| 66 $t_3$ | 65 $t_2$ | 64 $t_1$ | | | 68 $v_2$ | 67 $v_1$ | |

71

Figure 2

METHOD AND APPARATUS FOR EMULATING A FREQUENCY MODULATION DEVICE

BACKGROUND OF THE INVENTION

The present invention relates generally to the field of audio signal processing, and more particularly to a method and apparatus for emulating a frequency modulation sound chip.

In the early days of personal computers, the quality of audio produced by computers was primitive at best. Initially, personal computers could only produce single frequency beeps. The industry responded to the lack of high quality audio with a frequency modulation (FM) scheme that could produce multi-frequency audio signals. While frequency modulation has been generally discarded by the computer industry in favor of newer computer audio formats, a large base of FM applications remains among users that must still be supported.

FIG. 1*a* is a block diagram of a computer 5 including a central processing unit (CPU) 10 and peripheral cards 18, 19 and 20. Normally, one of the peripheral cards is a prior art sound card 20. CPU 10 is typically in communication with the peripheral cards, including sound card 20, through a system bus, such as NuBus, PCI, ISA or EISA. An application written to run on CPU 10 may interact with memory on the peripheral cards.

FIG. 1*b* is a block diagram of the prior art sound card of FIG. 1*a*. Sound card 20 typically includes an FM sound chip 30, memory 31, a digital to analog converter 32 and an amplifier 33. Usually, an application utilizing the FM audio standard (not shown) running on CPU 10 would communicate directly with FM chip 30 on sound card 20. Two of the most common FM chips are Yamaha Corporation's OPL2 and OPL3 FM chips. The operation of the OPL2 and OPL3, and similar types of FM chips, is described in Yamaha's Application Manual for the OPL3, 1992, which is incorporated herein by reference for all purposes.

A feature of FM based sound cards is that an FM application typically need only write information to the FM chip 30 without further follow up. FM chip 30 receives the appropriate information from the FM application and produces the appropriate digital version of the sound. Digital to analog converter 32 converts the digital information into an analog audio signal. The audio signal is typically amplified by amplifier 33 before being sent to a speaker 34. Speaker 34 is typically a built-in speaker within computer 5, or an external speaker.

While FM chips have been useful in the computer industry by allowing software applications running on computers to create richer audio, the use of FM has waned. Advances in sound card technology have enabled computers to produce higher quality audio than those produced by FM. However, due to the large base of FM applications already in existence, sound cards must still support FM audio. Typically, the solution has been to include an FM chip on each sound card. The requirement of backward compatibility thus increases the cost and complexity of current sound cards.

FIG. 2 is an address memory map 40 of an FM chip 30. The address memory map may include two banks of registers, bank0 41 and bank1 42. FM chips produce sounds based upon operators, as discussed further herein. The FM application provides certain information to FM chip 30 about the frequency and envelope (amplitude) of the desired audio signal to be generated by each operator of FM chip 30.

Thus, memory map 40 contains registers and bits for receiving frequency and envelope information about the various operators. These data elements will be referred to and described in detail in connection with the discussion of FIGS. 3 through 12*b*.

FM chip 30 can typically handle either 18 or 36 operators. Each bank of registers 41 and 42 corresponds to 18 operators. If FM chip 30 handles only 18 operators for purposes of backward compatibility with older FM sound chips, then only bank0 41 is available for use by the FM application. If FM chip 30 can handle 36 operators then both banks 41 and 42 can be used. As can be appreciated, an eighteen operator FM chip is a subset of a thirty-six operator FM chip. Thus, a thirty-six operator FM chip can operate in an eighteen operator mode. A full explanation of all the registers of the banks can be found in the application manuals for the specific FM chip, for example, Yamaha's Application Manual for its OPL3 FM chip.

FIG. 3 is a block diagram of an operator 59. Each operator 59 includes an oscillator 60 and an envelope generator 62. Registers in the address memory map 40 provide the needed frequency and envelope data for operator 59 to generate the appropriate audio signal. Each operator 59 is one of two operators in a voice 63. The attack rate 35, decay rate 36, sustain level 37, release rate 38, key scale level 43, key scale rate 77 and the total level 44 registers generally define the envelope of each operator. Referring back to FIG. 2, each operator has a corresponding set of envelope registers 35–38, 43, 77 and 44.

FIG. 4*a* depicts the attributes of a typical envelope. The key scale level 43 and total level 44 registers define an attenuation level 45 of the audio signal from 0 dB. The contents of key scale level register 43 is a variable which adjusts the attenuation according to the frequency of the operator output to reduce the amplitude of higher frequency components, while the value of the total level register 44 is typically a fixed number.

Attack rate 35 defines the rate of ascension of the audio signal from attenuation level 45 to 0 db. Decay rate 36 defines the rate of descent from 0 dB to the sustain level 37. Release rate 38 defines the rate of descent of the audio signal from sustain level 37. Key scale rate 77 adjusts the rates according to the frequency of the operator, making higher frequency components shorter in duration.

FIG. 4*b* is a timing signal of a key_on bit of a voice 63 of which operator 59, whose output is depicted in FIG. 4*a*, is a part. The attack of the audio signal is triggered by the key_on bit 46. Once the key_on bit 46 of the voice is set, operator 59 begins generation of the envelope. The generation of the envelope proceeds from attack, decay and sustain until the key_on bit 46 is reset. The envelope then begins to release according to the release rate 38. The key_on bit 46 can be reset at any time during the generation of the envelope, i.e., the envelope will begin to release during the attack, decay or sustain if the key_on bit 46 is reset during those intervals.

FIG. 5 is a typical output of a non-feedback operator. Sine generator 60 generates a sine wave based upon the frequency 47 and block 43 of the voice 63 that operator 59 is a part of, and the multiplier 49 of the operator 59. Frequency 47 is typically a ten bit value, broken up into two addresses. Frequency 47 defines the note to be played within a specified octave. The octave is defined by block 48. The frequency 47 and block 48 define the frequency of a voice 63, or operator pairs. The individual multiplier for each operator 59 defines the frequency ratios between the two operators of voice 63, based upon the frequency of voice 63.

Given a frequency for an operator, the output of an operator resembles an amplitude modulated signal. The operator audio signal output can be represented as $O(t)=A_o\sin(\omega_o t)$, where $A_o$ is the amplitude of the envelope, and $\omega_o$ is the frequency of the output of operator 59.

FIGS. 6*a* to 6*f* are different configurations of operators forming a number of different types of voices 63(0)–63(5). A typical voice 63 includes a pair of operators 59(0) and 59(1) in one of two configurations, additive or FM. In the additive configuration voice 63(0), the outputs of the operators 59(0) and 59(1) are simply added together, as seen in FIG. 6*a*.

In the FM configuration voice 63(1), as seen in FIG. 6*b*, the output of one operator 59(0) becomes another frequency input to the other operator 59(1). Typically, the first operator is called a modulator 59(0) and the second operator is called a carrier 59(1). The resulting output of the voice 63 is represented as $FM(t)=A_c\sin(\omega_c t+A_m\sin(\omega_m t))$. $A_c$ is the amplitude of the envelope of carrier 59(1) and $\omega_c$ is the frequency of carrier 59(1).

As suggested earlier, typically one of the operators in a voice can be used in a feedback mode. The feedback can have a variable gain, β, as set in feedback register 50. The resulting output of the feedback operator is $O_{fb}(t)=A_o\sin(\omega_o t+\beta O_{fb}(t))$. Thus, an FM voice with a feedback modulator would have the output $FM(t)=A_c\sin(\omega_c t+A_m\sin(\omega_m t+\beta O_m(t)))$. As can be appreciated, voice 63 can produce an audio signal rich with a large number of harmonics. A voice with two operators is typically referred to as a melodic voice.

In another voice configuration, four operators can be utilized to produce a four operator voice. In the prior art FM chips, typically only four of the more commonly used four operator configuration voices 63(2)–63(5) are available, as seen in FIGS. 6*c*–6*f*. The outputs of the illustrated four operator voices can be determined by applying the operator and voice equations previously discussed. The operators of the illustrated examples of four operator voices are depicted as non-feedback operators, but as can be appreciated, the operators may be feedback operators in any suitable combination within the four operator voice.

Alternatively, a single operator can be utilized independently to provide an output. A single operator voice is typically referred to as a rhythm voice, however a rhythm voice may also utilize two operators in an FM configuration. FM chip 30 can be put into a rhythm mode by setting a rhythm bit 55 in address memory map 40. Rhythm mode allows three dual operator voice pairs of the FM chip to operate in rhythm mode. Normally, four single operator rhythm voices are paired within two dual operator additive voices, since each rhythm operator is not a separate voice which are summed as part of the final output. The third dual operator rhythm voice is a two operator voice typically in an additive configuration.

Four of the unique rhythm sounds that utilize the additive rhythm voices are snare drum, tom-tom, top cymbal and hi hat. The operator selected to produce one of the rhythm sounds receives a noise signal from a noise generator as the frequency input of the operator, except for tom-tom, which receives a sine wave. The envelope of the operator can be set by the user. The output is normally added to the other operator in the dual operator voice to fully utilize both operators of a dual operator additive voice. By way of example, a tom-tom operator is added to a hi hat operator to produce a combined voice of a tom-tom and hi-hat sounds. Snare drum 51, tom-tom 52, top cymbal 53 and hi hat 54 bits activate the appropriate operators.

The bass drum rhythmic sound normally utilizes a dual operator voice in an additive configuration. Typically, the bass drum rhythmic operators do not utilize a noise signal, but is more similar to a melodic voice in additive mode. Bass drum bit 56 activate the voice used to produce the bass drum voice.

In prior art FM chips the number of combinations of single operator voices, double operator voices, and four operator voices are limited. Typically, a thirty-six operator FM chip can only use its thirty-six operators to produce a limited combination of six four operator voices, eighteen melodic dual operator voices, four single operator rhythmic voices, and one dual operator rhythmic voice, any combination amounting to no more than thirty-six operators.

FIG. 6*g* depicts a typical block diagram of the resulting audio signal produced by FM chip 30. Typically, all the voices 63(0)–**63(*m*), where m is the number of voices available in FM chip 30**, are added together, whether single, dual, or four operator voices. The product of the voices is an audio signal, either monaural, stereophonic or quadraphonic. Typically, the audio signal is a pulse code modulated signal, which is later converted to an analog audio signal.

As can be appreciated, an FM application running on CPU 10 need only write the values of the various frequency and amplitude values to FM chip 30 and assert the appropriate key_on bits 46 to produce a complex audio signal. Typically, the FM application need not read data back from FM chip 30, unless the FM application requires the use of one of two timers typically included within FM chip 30. Bits of register 72 are used to start the timers, mask the timer overflow bits, and reset the overflow bits.

To utilize the onboard timers of FM chip 30, the FM application need only write to registers timer1 57 and timer2 58 to set the counts for the timers. The FM application then polls timer1 and timer2 overflow bits 64 and 65 to determine whether the timers have triggered. A third timer overflow bit 66 is the logical or of timer1 64 and timer2 65 overflow bits.

Within the same address space as the timer overflow bits are version bits 67 and 68. The address space is referred to as a control status register 71. Initially, the FM application can read control status register 71 to determine what type of FM chip is available. That is, whether FM chip 30 has either eighteen or thirty-six operators. Additionally, the FM application has the option to use only eighteen operators of a thirty-six operator FM chip, or utilize all the operators. The FM application can typically set mode bit 69 to select full thirty-six operator mode.

As noted above, due to the large base of FM applications already in existence, new sound cards must still support FM audio. Typically, the solution has been to include an FM chip on each sound card. As can be appreciated from the foregoing, FM chips are complex and the number of computations necessary to generate a frequency modulated sound is considerable. The number of logic devices, or gates in a single semiconductor device, required to perform the computations is also large. Additionally, FM devices are task specific and cannot be used for purposes other than generating FM sounds. Thus, the cost of implementing FM synthesis in hardware to support older FM applications remains is a significant concern.

In the meantime, recent advances in computer systems and CPUs have dramatically increased the ability of computer systems to handle complex computations at faster speeds. Processing capability has increased so much :hat current computer systems are often times not fully utilized to their full potential when running legacy FM applications.

The cost of a new sound card could be significantly reduced and efficiency gained if this increased processing capability could somehow be exploited to eliminate the need to include an FM chip on new sound cards.

SUMMARY OF THE INVENTION

Accordingly, the present invention provides a method and an apparatus of utilizing the unused capacity of current computer systems to perform the task of generating frequency modulated sounds and thereby reduce the cost and complexity of the hardware necessary to support frequency modulation applications. Removing much of the added cost of supporting FM synthesis leaves more real estate and resources to add further functionality to new sound cards.

In one embodiment, the frequency modulation emulation apparatus includes a frequency modulation emulator suitable to communicate with a computer system. The frequency modulation emulator provides an addressable memory space that is substantially similar to an emulated addressable memory space of the emulated frequency modulation sound chip, such that a frequency modulation application implemented on the computer system can communicate with the frequency modulation emulator. The emulator chip thereby receives audio data through the addressable memory space from the frequency modulation application. The frequency modulation application is unaware that the frequency modulation emulator is receiving the audio data rather than the emulated frequency modulation sound chip. A frequency modulation generator is implemented on the computer system. The frequency modulation generator receives the audio data from the frequency modulation emulator chip. The frequency modulation generator processes the audio data to produce an audio signal in a manner that is substantially similar to the operation of the emulated frequency modulation sound chip. Thus, minimal hardware is used to emulate a frequency modulation sound chip. Instead, excess processing capacity of current computer systems is exploited.

These and other features and advantages of the present invention will be presented in more detail in the following specification of the invention and the figures.

BRIEF DESCRIPTION OF THE DRAWINGS

FIG. 2 is an address memory map of a prior art FM chip.

DETAILED DESCRIPTION OF THE INVENTION

The present inventions provide a method and apparatus for emulating a frequency modulation sound chip with minimal hardware and software operating on a computer. Emulation of an FM chip in software reduces the costs and complexity of current and future sound cards, while still providing backward compatibility for the large number of FM applications still in use. In one embodiment of the present inventions, the minimal amount of hardware can be implemented on a sound card. In another embodiment, the frequency modulation generator software can be implemented on a computer system, utilizing the excess capacity of the computer system.

The present inventions take advantage of the fact that an FM application typically need only write a stream of audio data to a prior art type FM chip. Thus, the present inventions contemplate utilizing a minimal amount of hardware on a sound card to create a facade identical to a prior art type FM chip to the FM application. The majority of the computational hardware is implemented in software in an FM generator application. Due to the increased power and speed of current CPUs, the FM generator application can run concurrently with the FM application. The present inventions reduce the amount of hardware needed on a sound card while efficiently using the unused capacities of today's high powered CPUs. Therefore, legacy FM applications can be adequately supported in current and newer sound cards without the expense of custom FM sound chips.

One of the many novel features of the present inventions includes the use of a minimal amount of hardware that provides a facade of an FM sound chip being emulated to an FM application running on a computer system. The hardware, or the FM emulator, creates an addressable memory space that is substantially similar to an addressable memory space of the emulated FM sound chip. The FM application conducts operations with the hardware as if the FM emulator chip were a true FM sound chip.

The FM application provides audio data that describes the desired FM sound to the FM emulator. Rather than performing the computations in hardware, as in prior FM sound chips, the FM emulator hardware is passive. The FM generator retrieves the information from the FM emulator. In one embodiment of the application, the FM generator is implemented on the computer system concurrently with the FM application. The FM generator utilizes the processing power of the computer system to perform the synthesis of the desired FM sound. The present inventions, thereby, reduce the amount of expensive hardware necessary to generate FM sounds while utilizing the unused capacity of today's higher powered computer systems.

Figure 1A:
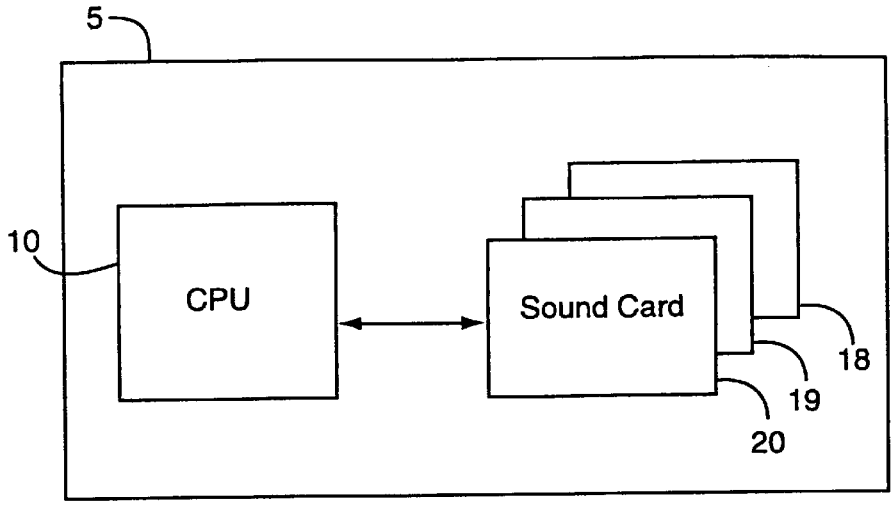
FIG. 1a (Prior Art)
FIG. 1*a* is a block diagram of a computer system including a CPU and a prior art sound card.
Figure 1B:
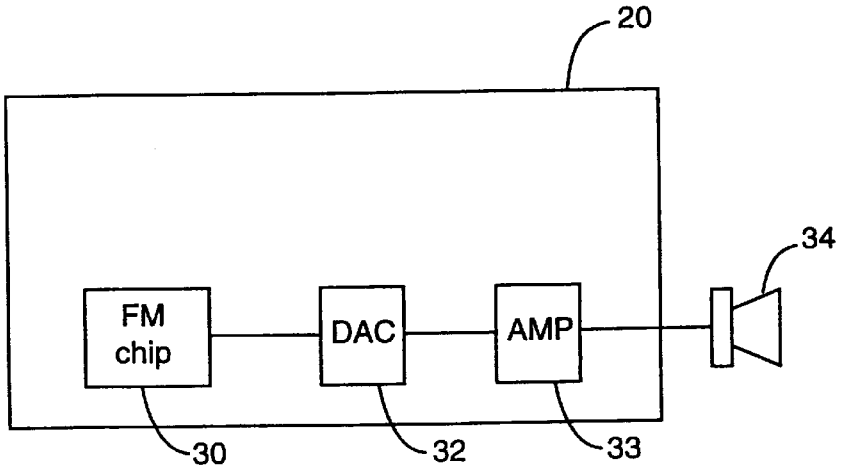
FIG.1b (Prior Art)
FIG. 1*b* is a block diagram of the prior art sound card in FIG. 1*a*.
Figure 3:
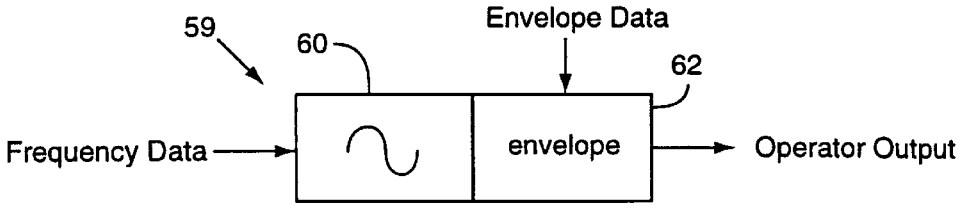
FIG. 3 (Prior Art)
FIG. 3 is a block diagram of an operator.
Figure 4A:
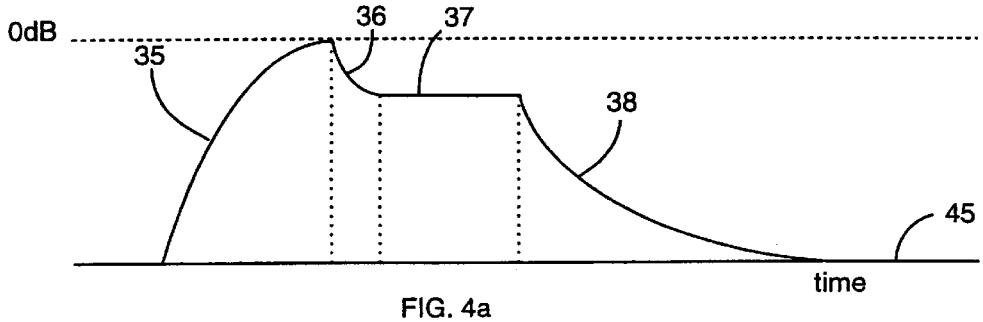
FIG. 4*a* is an exemplary plot of a signal generated by an envelope generator.
Figure 4B:
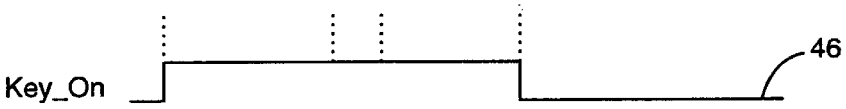
FIG. 4*b* is a key_on bit timing diagram corresponding to the envelope signal of FIG. 4*a*.
Figure 5:
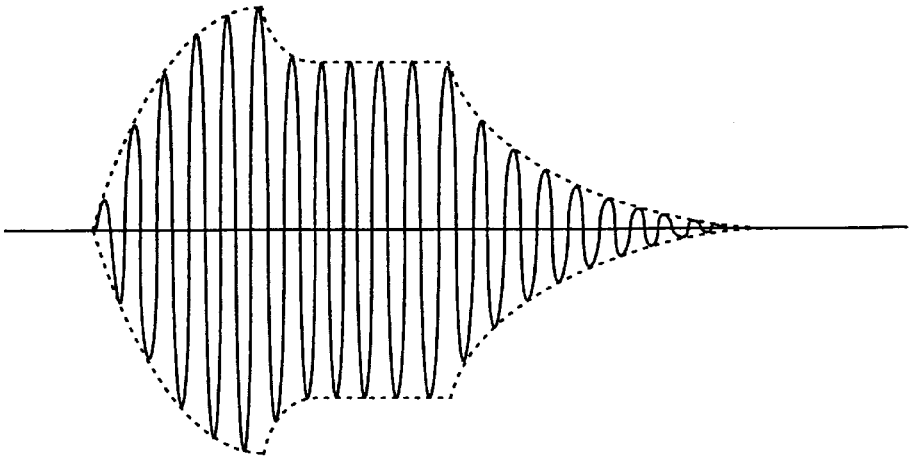
FIG. 5 is an exemplary plot of an output of an operator.
Figure 6A:
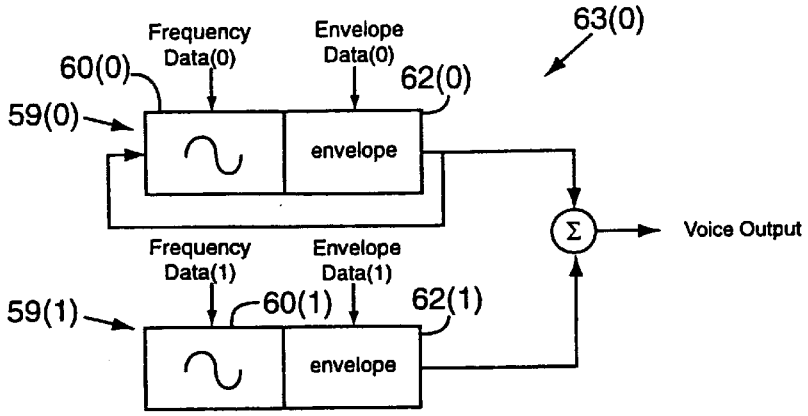
FIG. 6*a* is a block diagram of an additive configured voice.
Figure 6B:
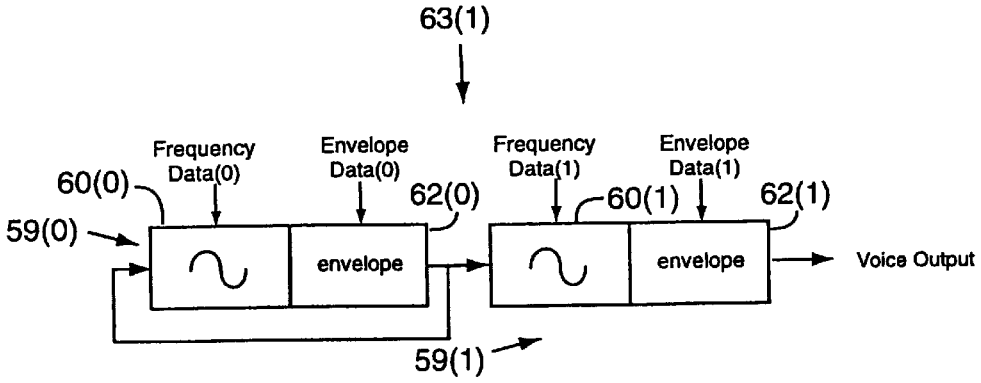
FIG. 6*b* is a block diagram of a frequency modulation configured voice.
Figure 6C:
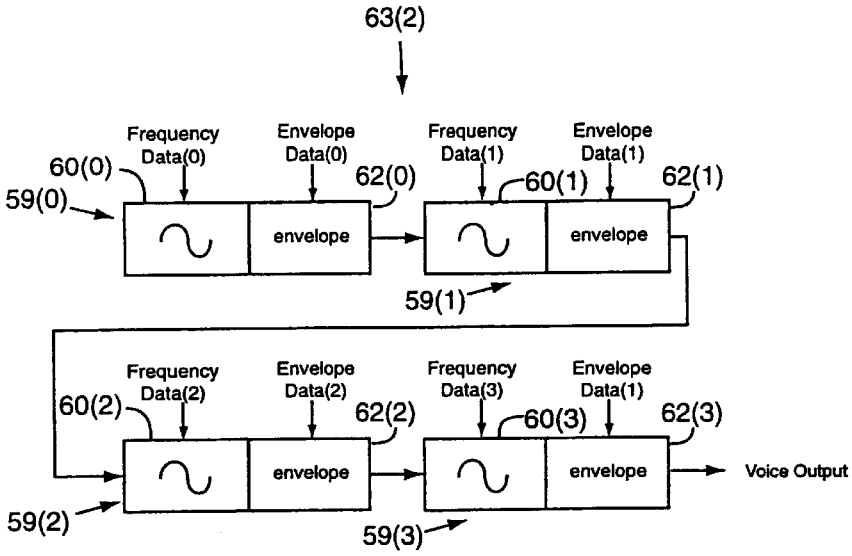
FIGS. 6*c–f* are block diagrams of four configurations of four operator voices typically available in prior art FM chips.
Figure 6D:
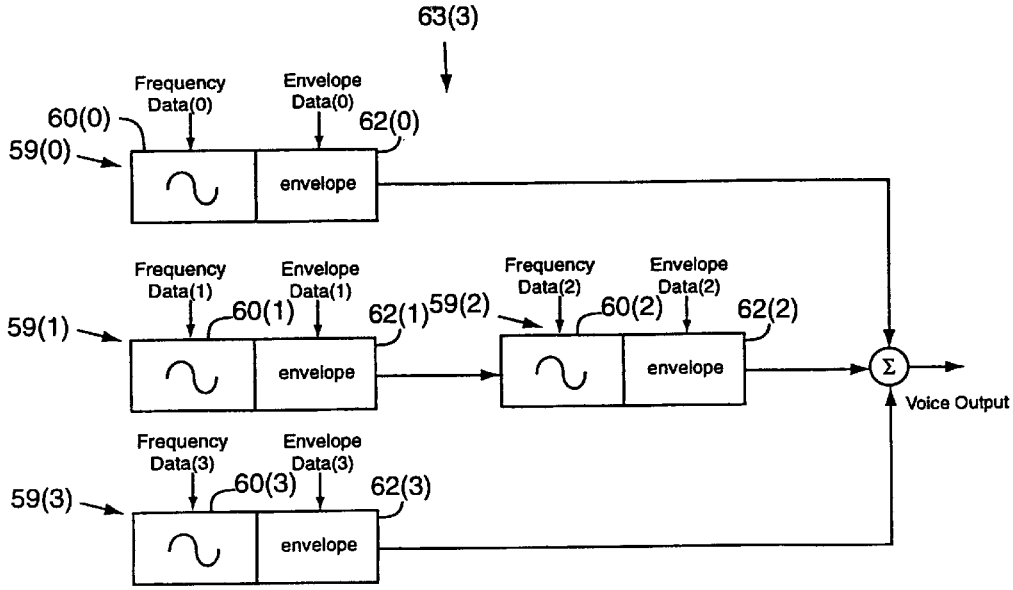
Figure 6E:
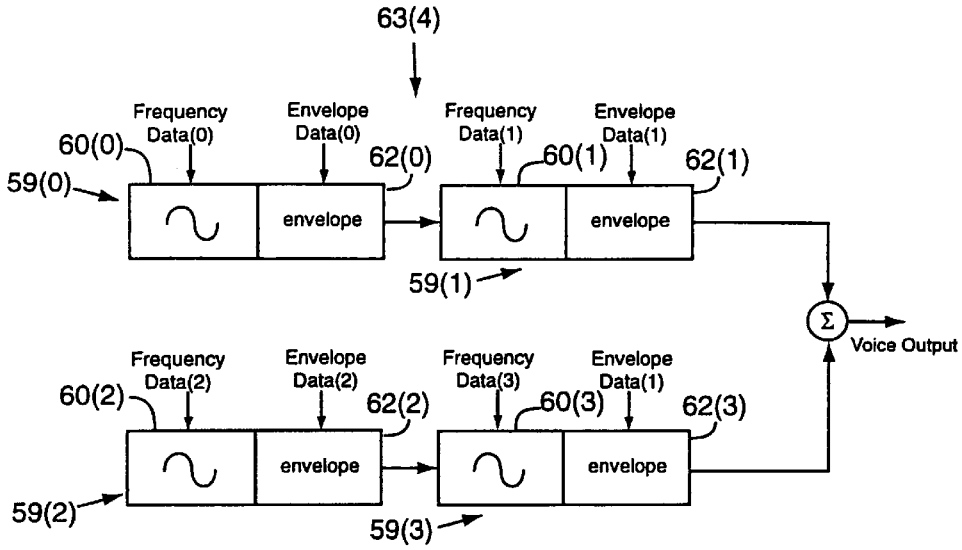
Figure 6F:
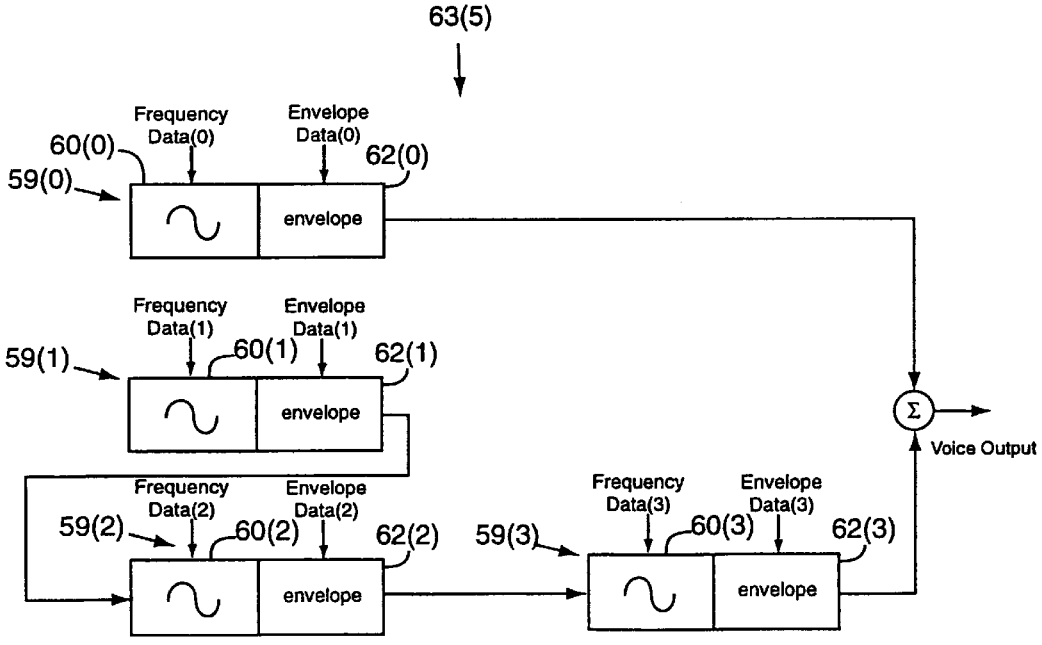
Figure 6G:
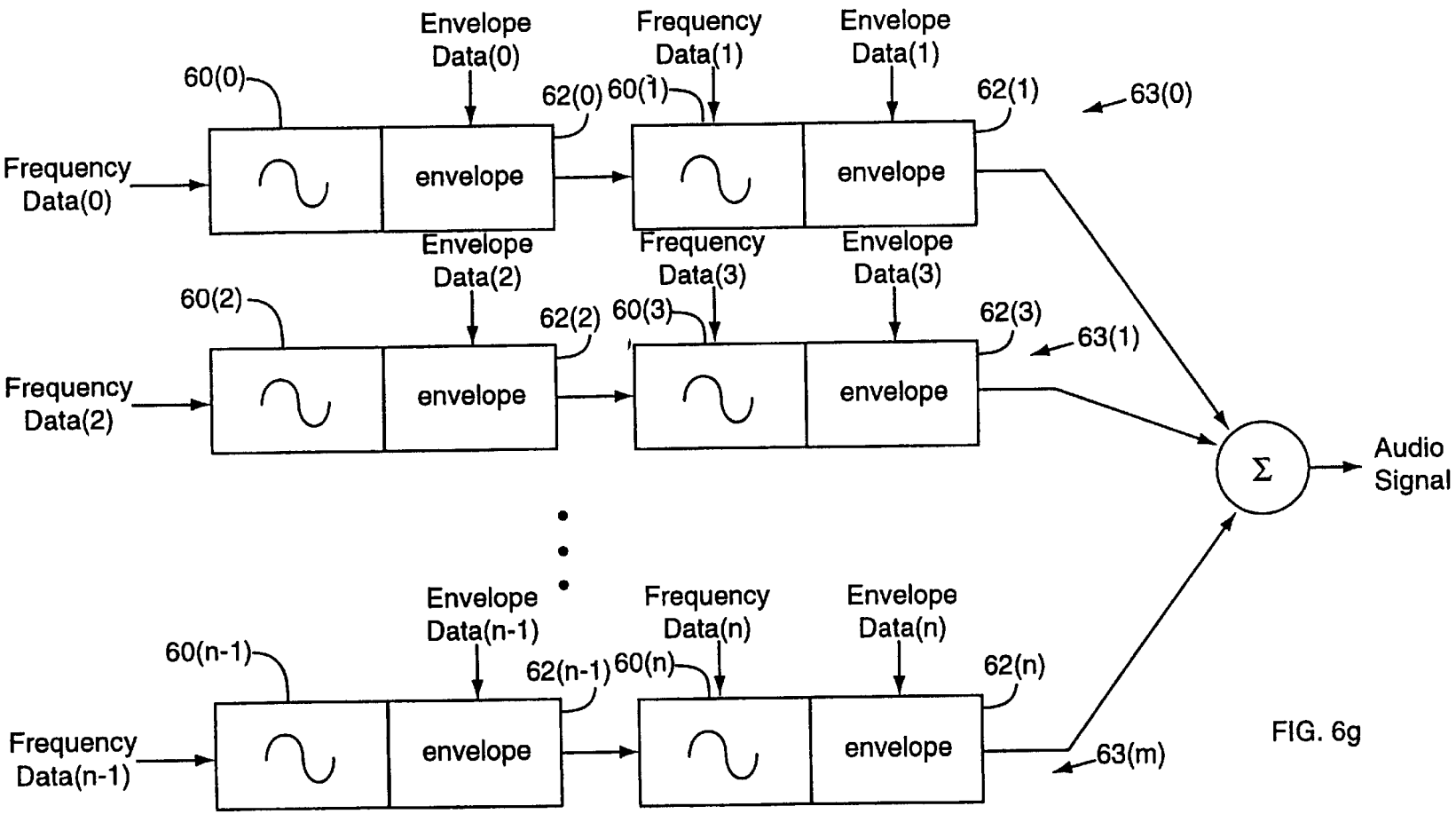
FIG. 6*g* is a block diagram of the production of an audio signal.
Figure 7:
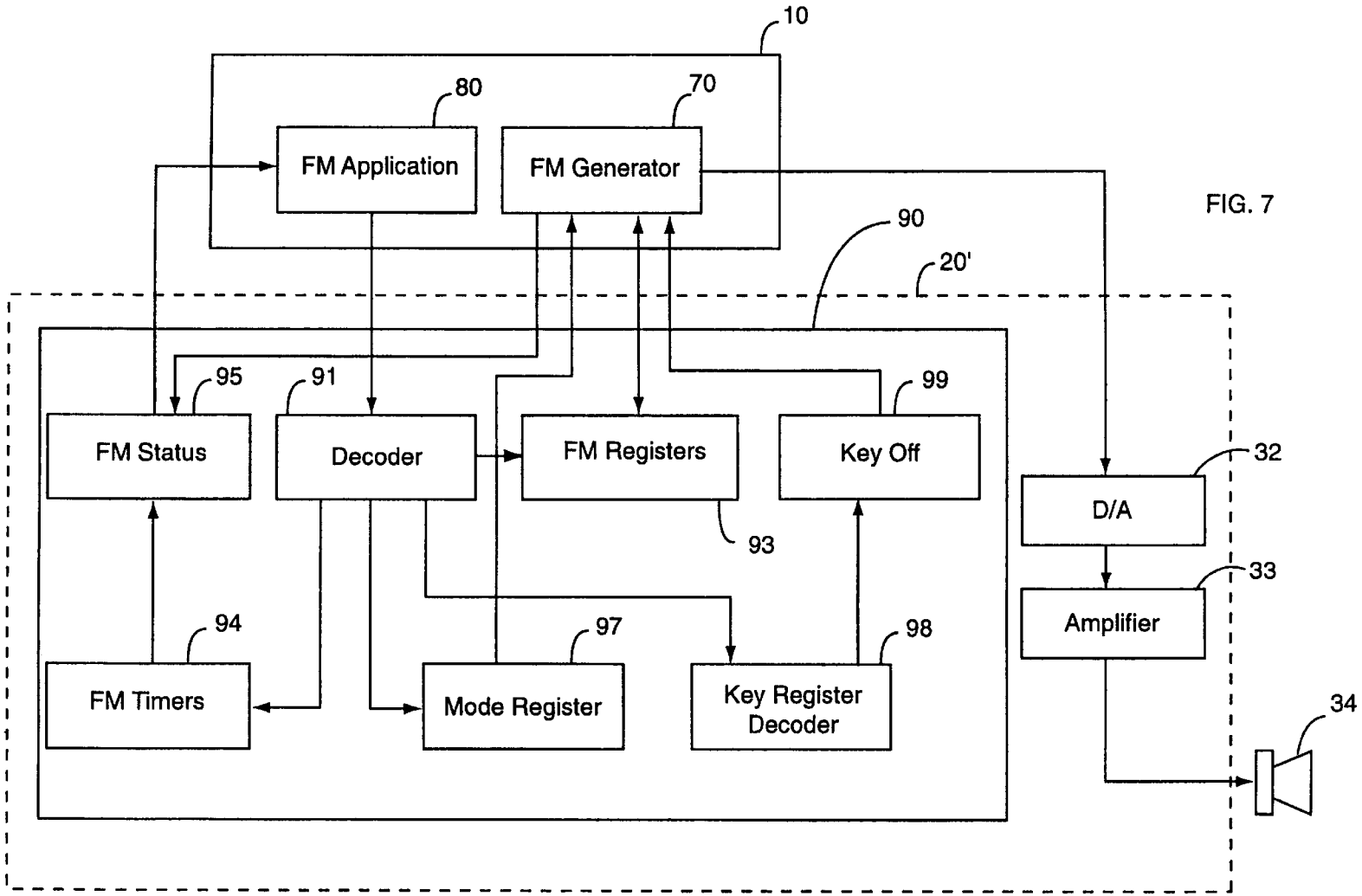
FIG. 7 is a block diagram of a frequency modulation emulator in accordance with one embodiment of the present inventions.

FIG. 7 illustrates a block diagram of a CPU 10 and a sound card 20', in accordance with one embodiment of the present inventions, implemented in a computer system. In the illustrated embodiment, FM application 80 and an FM generator 70 are simultaneously implemented by CPU 10. In alternate embodiments, the FM generator can be implemented on a computer, a computer system, or any other type of suitable computing device that can concurrently implement FM generator 70 and FM application 80, including, by way of example, central processing units and digital signal processors.

In another embodiment, FM generator 70 can be a terminate and stay resident application, commonly used in IBM PC compatible personal computers. In another embodiment, FM generator 70 is a $V_xD$ application implemented by CPU 10 running a Windows environment. In alternative embodiments, any suitable type of program can be utilized to implement FM generator 70. By way of examples, FM generator 70 can also be any type of memory resident program that can share processing time with other applications.

Sound card 20' includes an FM emulator 90, a digital to analog converter 32 and an amplifier 33. FM emulator 90 can be any type of suitable logic device capable of communication with a computing device implementing FM generator 70 and FM application 80. In the illustrated embodiment, FM emulator 90 is a single chip in communication with FM application 80 and FM generator 70, by way of CPU 10. FM emulator 90 may include a decoder 91, FM memory 93, an FM timers 94, a FM status register 95, a mode register 97, a key register decoder 93, and a key off register 99.

In the illustrated embodiment of the present invention, FM application 80 provides audio data in accordance with one of the various FM formats directly to decoder 91. FM application 80 is also able obtain the minimal amount of information that the FM application 80 requires through FM status register 95. To FM application 80, the combination of decoder 91 and FM status register 95 create an address memory map facade 40' identical to a prior art FM chip (the emulated addresses are denoted with a prime for reference purposes).

Thus, the address memory map of FIG. 2, or similar FM chip memory maps, may be identically replicated by decoder 91 and FM status register 95. FM status register may thus map to control status register address 71', typically the only readable address of a prior art FM chip. The decoder is addressed and written to by FM application 80 according to the addresses of an FM chip memory map being emulated.

FM generator 70 and FM emulator 90 may be configured to emulate any type and version of prior art FM chips. Since Yamaha's OPL3 FM chip, a stereo thirty-six operator FM chip, is commonly used, and is backward compatible with eighteen operator FM chips, the illustrated embodiment of the present inventions emulates an OPL3 FM chip.

In the illustrated embodiment, FM application 80 initially may poll FM status register 95 at control register address 71' in order to determine which type of FM chip is available. Version bits 67' and 68' of FM status register 80 provides the FM application 80 with information about the type of FM chip FM generator 70 and FM emulator 90 are emulating. In the illustrated example, FM status register 95 would indicate that the FM chip is an OPL3 chip. After providing the relevant initialization data, as discussed further herein, FM application 80 may also poll the FM status register 95 in order to utilize the timers of the emulated FM chip.

After determining what type of FM chip is available, FM application 80 may proceed to write initialization data to decoder 91. Initially, FM application 80 may set mode bit 69' to indicate whether the FM application 80 would like to take advantage of all thirty-six operators available to it in the emulated OPL3 FM chip. In another embodiment, the default of the new mode bit 69' may be a logical zero, thus setting an eighteen operator FM chip as the default.

If the FM application 80 chooses to select the thirty-six operator mode, mode bit 69' is passed to mode register 97. Mode register 97 is addressable by FM generator 70.

Should the FM application 80 require the use of timers, FM application 80 may write the appropriate timer data to decoder 91 at timer1 and timer2 address spaces 57' and 58'. Decoder 91 routes the timer data to FM timers block 94. FM timers block 94 may include two variable timers. The timing of the timers in FM timers block 94 may be set by the values written into the timer1 57' and timer2 58' registers. The overflow of the timers in FM timers block 94 typically sets overflow bits 64' and 65' of the FM status register 95. The various operation of the timers is controlled through register 72', such as starting, masking and resetting the timer overflow bits 64' and 65'.

FM application 80 may then write all the relevant audio information required to produce audio sounds to decoder 91. Audio information typically includes frequency data and envelope data, such as key scale level 43', total level 44', attack rate 35', decay rate 36', sustain level 37', release rate 38', frequency 47', block 48', rhythm mode 55', bass drum 56', snare drum 51', tom-tom 52', top cymbal 53', hi hat 54' and other operator and voice values utilized by an FM chip, as discussed in further detail in Yamaha's OPL3 application manual.

To reiterate, the audio information is written to decoder 91 by FM application 80 as if the FM application 80 were addressing the emulated FM chip. However, the audio information is stored in FM registers 93. Referring back to FIG. 2, portions of the memory map 40 are not utilized. Thus, the audio information is reorganized in FM registers 93 to minimize the amount of memory required to store all the audio information. The audio information in FM registers 93 may then be read by FM generator 70.

FM application 80 must typically also set the key_on bits 46' to initiate the generation of audio. FM application 80 writes to decoder 91 to set or reset the key_on bits 46'. The key_on bits 46' and rhythm bits 55' are passed along to key decoder 98. Key decoder 98 passes the values of key_on bits 46' to key registers 99 to be read by FM generator 70. Additionally, key decoder 98 also provides melodic and rhythmic transition bits 73 and 74, respectively, to FM generator 70 by way of key registers 99, which is discussed in further detail herein.

In the illustrated embodiment, FM emulator 90 thereby provides a hardware facade of an FM chip. FM emulator 90 also provides a channel through which FM application 80 can pass along the required audio information to FM generator 70 for the generation of audio as if communicating with a true FM sound chip. However, FM emulator 90 passes the audio information to FM generator 70, which does the actual computation of the desired FM sound. Additionally, FM emulator 90 may include timers and timer overflow flags in order to fully emulate an FM chip.

Figure 8:
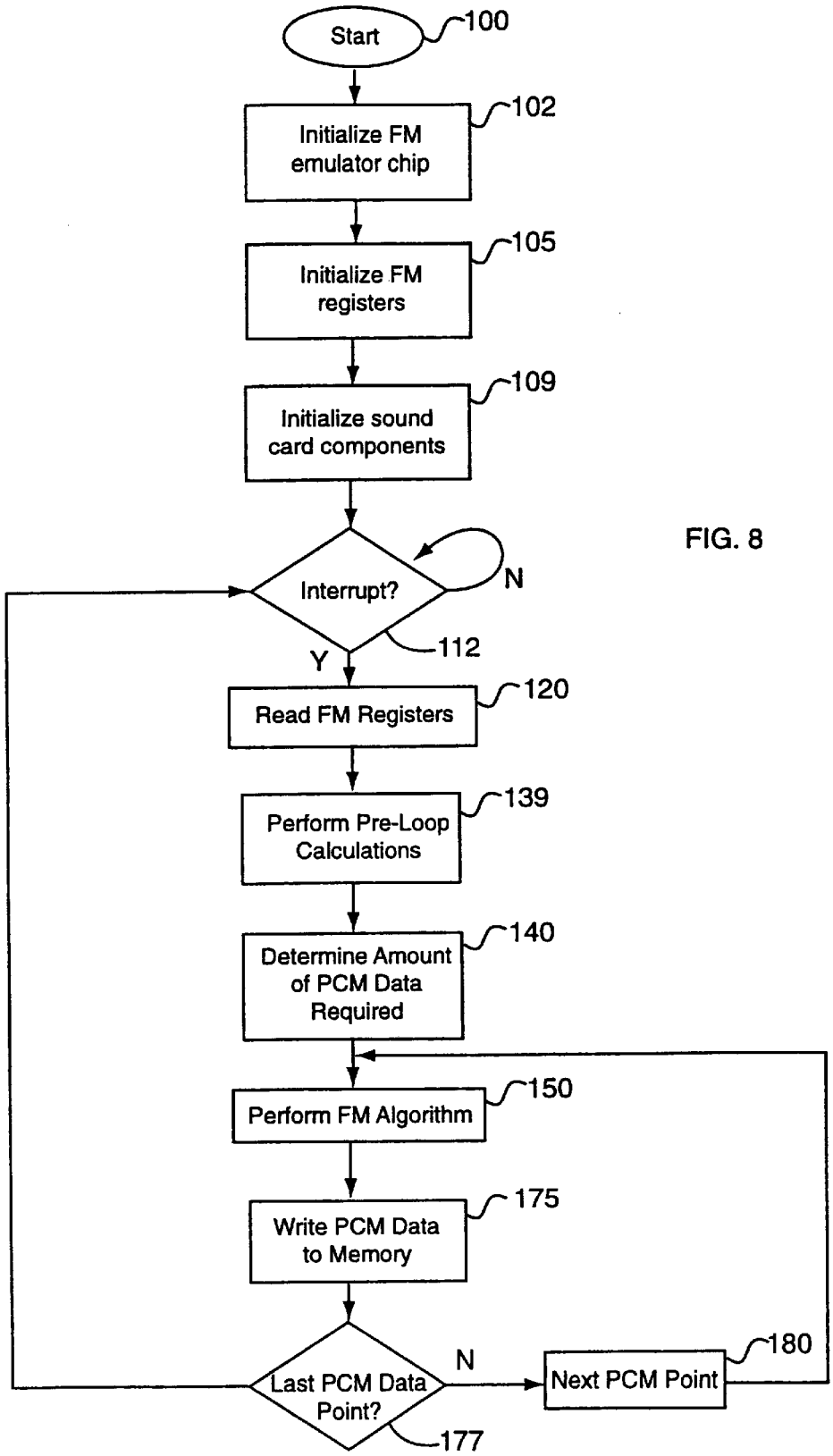
FIG. 8 is a flow chart of a computer-implemented method of generating frequency modulated voices, in accordance with one embodiment of the present inventions.

FIG. 8 is a flow chart illustrating a process implemented in FM generator 70.

FM generator 70 starts at block 100, typically triggered by the start up of the computer system upon which FM generator 70 has been implemented. Once FM generator 70 has been initiated, FM generator 70 proceeds to block 102 and initializes the FM emulator 90. In one embodiment, the initialization step 102 includes resetting the timers in FM timers block 94, After successfully establishing communications with FM emulator 90, FM emulator initializes the values of FM registers 93 in step 105. Upon start up of FM emulator 90, the states of the FM registers 93 are uncertain. However, FM generator 70 will need to access certain data from FM registers 93 soon after initialization. Thus, FM generator 70 is typically required to initialize the values in the FM registers 93.

In the illustrated embodiment, FM generator 70 sets up the FM registers 93 identical to the start up state of an OPL3 FM chip. In accordance with the illustrated embodiment, FM generator 70 may write zeroes to all the FM registers 93 except for the STL and STR bits 75' and 76'. In the illustrated embodiment, STL and STR bits are typically located at the fourth and fifth bits of address C0–C8 (hexadecimal) in both banks of address spaces of the emulated memory map 40'. STL and STR bits 75' and 76' are typically only used by an OPL3 FM chip to enable stereo output. Thus those bits are set such that when the OPL3 mode is initiated, i.e., thirty-six operator mode, audio output to both speakers for all voices is already enabled.

Step 105 may also include the initialization of FM status register 95, FM timers 94, mode register 97, key decoder 98 and key registers 99. In the illustrated embodiment, FM status register 95 includes timer1 and timer2 overflow bits 64' and 65', a third timer bit 66', and version bits 67' and 68'. These bits are typically reset, thus emulating the start up state of bits 64'–68' of an OPL3 FM chip. That is, the timer overflow bits 64' and 65' indicate no overflow and version bits 67' and 68' indicate that the FM chip being modulated is an OPL3 FM chip.

Mode register 97 typically includes the value of mode bit 69'. The OPL3 FM chip can operate in an OPL2 mode (i.e., eighteen operator mode), and its initialized state is in the OPL2 mode for backwards compatibility to FM applications written before OPL3 chips were available. Thus, mode bit 69' is reset in mode register 97 to indicate that the OPL2 mode of the emulated chip has been selected in step 105. Additionally, in block 105, the timers in FM timers 94 are reset and the registers and logic of mode register 97, key decoder 98 and key registers 99 are reset.

In block 109, a final step in the initialization phase of IM generator 70 is initiated—the initialization of the various other components on the sound board 20'. In one embodiment, digital to analog converter 32 and amplifier 33 are initialized. FM generator 70 proceeds to the next phase of the process, block 112. In block 112 FM generator 70 waits until an interrupt is received. The interrupt can be an internally generated interrupt or an interrupt generated by the operating system running on CPU 10. Typically, the interrupt is generated at 10 millisecond intervals. After an interrupt is received, FM generator 70 proceeds to step 120 and reads the data stored in FM registers 93.

Figure 9:
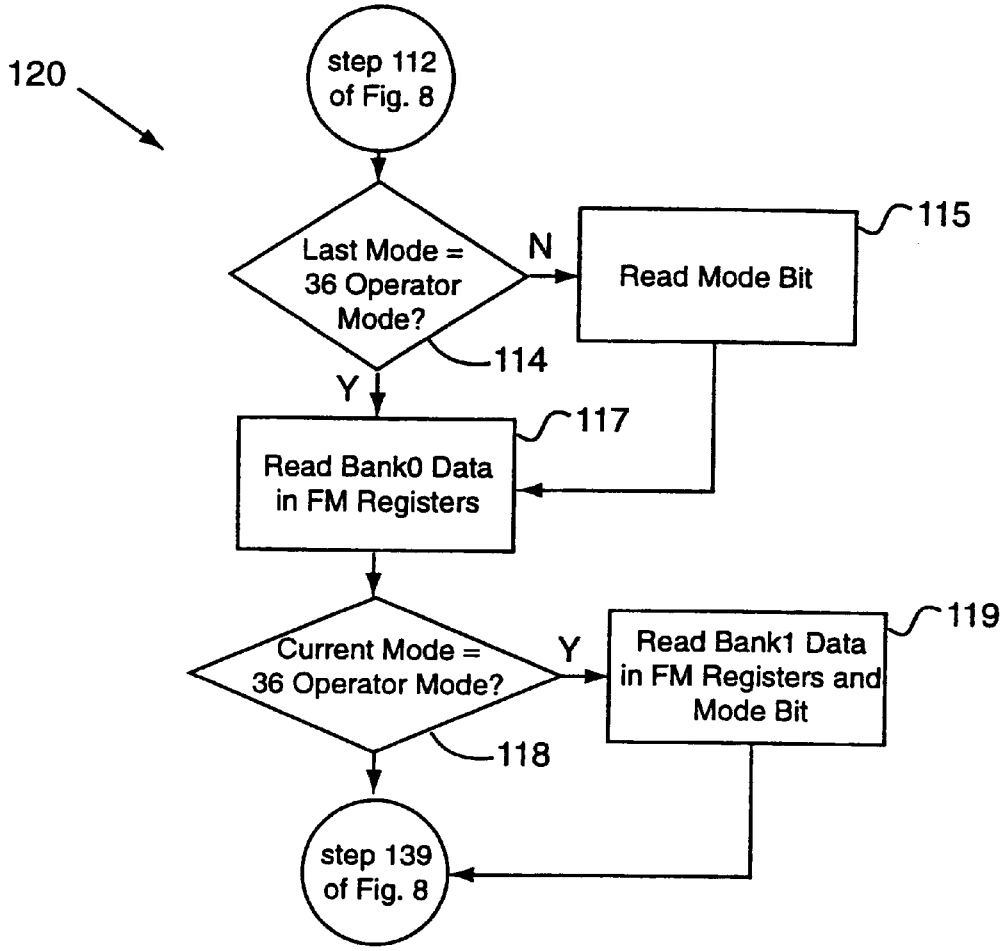
FIG. 9 is a flow chart of block 120 of FIG. 8.

FIG. 9 illustrates a sub-flowchart for step 120, reading the FM registers 93. At the outset of the reading process in step 114, FM generator 70 recalls which mode FM application 80 had selected prior to the interrupt. In the illustrated embodiment, if the last mode was not OPL3, FM generator 70 reads the mode bit 69' in mode register 97, in step 115, to determine if FM application 80 has selected the OPL3 mode since the last interrupt.

Both steps 114 and 115 lead to step 117, where FM generator 70 reads the data stored in the FM registers dealing with the eighteen operators of bank0 41'. The data related to the eighteen operators controlled through bank0 41' is always read no matter which mode the emulated FM chip is in, since they are a subset of the thirty-six operator mode.

In step 118, FM generator 70 determines if the current mode is the thirty-six operator mode. If the FM generator 70 is in thirty-six operator mode, the process proceeds to step 119. In step 119, FM generator 70 reads the data related to the remaining eighteen operators in bank1 42'. Additionally, in step 119, any thirty-six operator specific data is also read and the mode bit 42' is again read to determine what mode FM generator 70 should operate in after the next interrupt. FM generator 70 proceeds from steps 118 or 119 to step 139 back in FIG. 8.

Returning to the flow chart of FIG. 8, FM generator 70 performs pre-loop calculations in step 139. These calculations are typically computations that are necessary to be completed once per interrupt, the eventual output of FM generator 70. By way of examples, pre-loop calculations may include determining the attack rate 35' time constant, the number of samples required in the attack rate 35' and decay rate 36' portions of an envelope, the total level 44' value in bit conversion, computing the requested frequency from the frequency 47' and block 48' values, the sustain level 37' bit conversion (the amount to be added or subtracted from the accumulated envelope for each PCM data point), and envelope information. The pre-loop computations are done for each operator currently being utilized.

In the next step, 140, FM generator 70 determines how many PCM data points are required to fill up a memory buffer that will receive the PCM data points. FM generator 70 proceeds to the FM algorithm 150.

Figure 10:
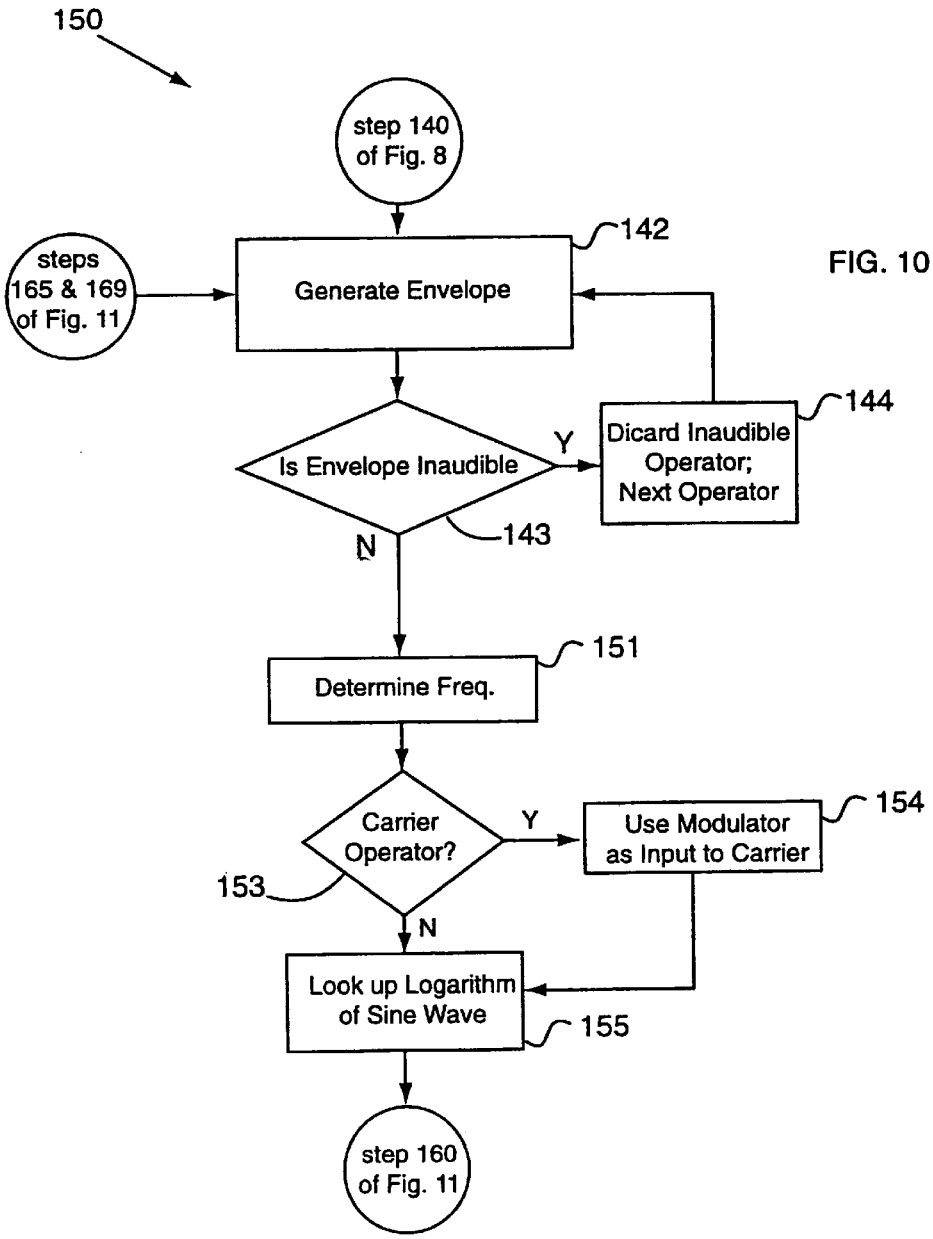
FIGS. 10 and 11 are flow charts of block 120 of FIG. 8.
Figure 11:
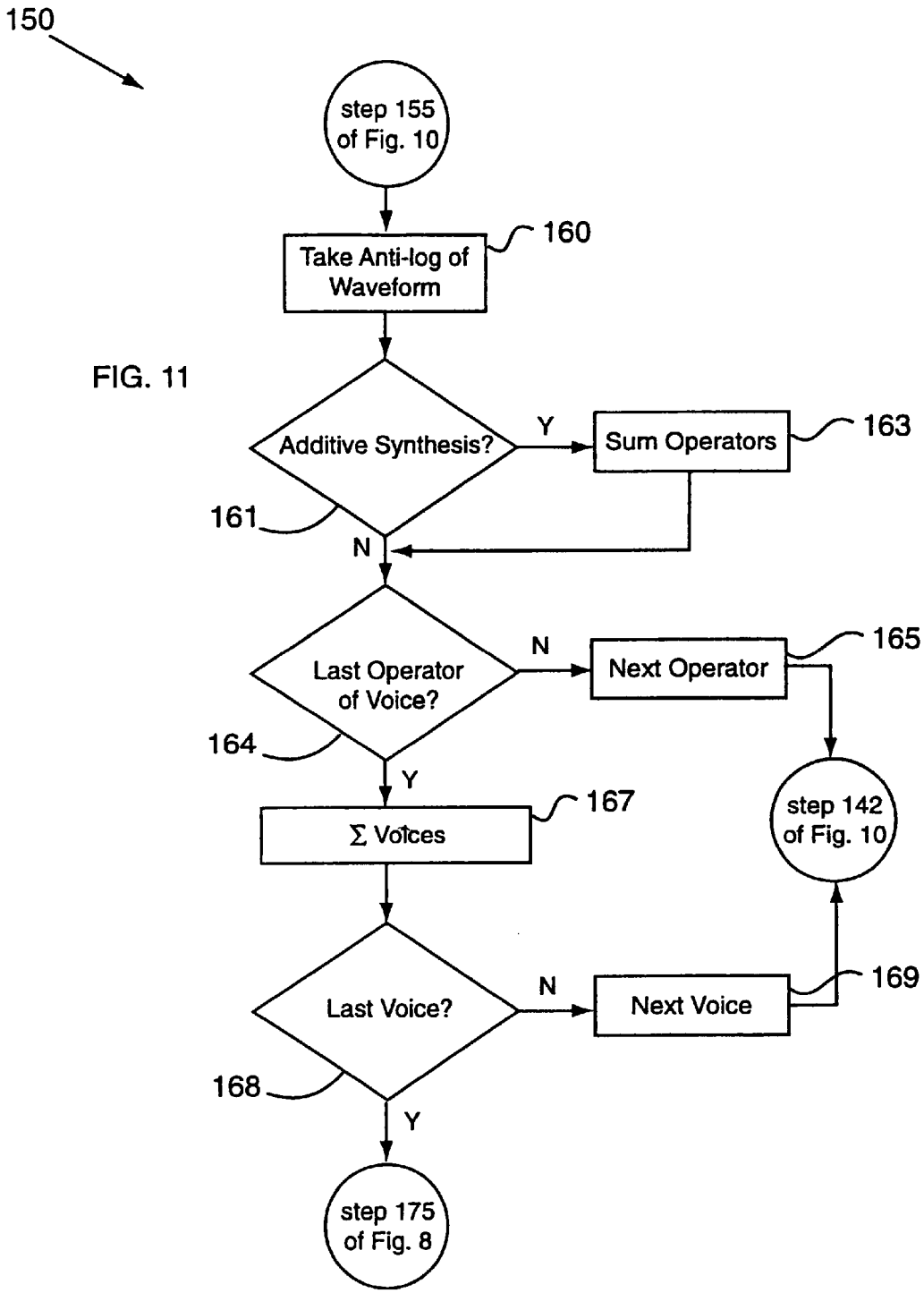

FIGS. 10 and 11 are the sub-flowcharts for the operation of the FM algorithm 150. Beginning at FIG. 10, FM algorithm 150 starts at step 142 and generates an envelope for an operator. In the illustrated embodiment, envelope deltas, or the change in the accumulated envelope since the generation of the last PCM data point is calculated. The calculations for the generation of the envelope may be done in logs to decrease the number of multiplies required to complete the computations. In step 143, FM generator 70 determines if the envelope of the operator is inaudible. In the illustrated embodiment, step 143 determines if the envelope delta does not contribute to the new PCM data point, i.e., does not have an audible effect. If the envelope delta is inaudible, the process proceeds to step 144 where it discards the inaudible operator and increments to the next operator. The envelope of the next operator is then generated by step 142.

If the envelope generated in step 142 is audible, then FM generator 70 proceeds from step 142 to the remainder of the FM algorithm 150. By bypassing all the inaudible voices, the efficiency of FM synthesis is increased.

FM generator 70 proceeds to step 151 and determines the frequency for the current operator. The frequency is normally computed by taking the data in the block register 48' to determine which octave the desired frequency is in. The frequency register value 47' then provides the specific frequency from the base octave.

In the next step, 153, FM generator 70 determines if the operator is part of an FM configured voice and if the operator is the carrier half of the FM voice. If the current operator is the carrier operator of an FM voice, the output of the previous modulator operator output is also included as part of the frequency input of the current operator. Either 153 or 154 then proceeds to step 155 where the FM generator 70 does a look up of the appropriate sine wave given the frequency inputs. In the illustrated embodiment, the lookup is done in a logarithmic look up table. Step 155 also generates the output of the current operator by combining the envelope with the frequency.

Turning to FIG. 11, in step 160, the antilog of the operator output waveform is taken to produce a linear waveform. Then, step 161 of the FM generator 70 determines whether the current operator is part of an additive voice. If the operator is part of an additive voice, the process proceeds to step 163 where the outputs of the additive operators are simply added together. If the operator is not part of an additive voice, FM generator 70 proceeds to step 164.

In step 164, FM generator 70 determines whether the operator is the last operator in the voice. If the operator is not the last operator in the current voice, the process proceeds to step 165 and the next valid operator in the voice is processed, proceeding back to step 142 in FIG. 10. If the current operator is the last operator of the current voice, then the output of the current operator is also the voice output if the voice is an FM configured voice. If the voice is an additive voice, the voice output is the sum of the operators of the voice, as accumulated in step 163.

In step 167, the voice output is summed with the outputs of the previous voices. Step 168 determines if the output of the last voice has been computed. If not, step 169 increments to the next voice, and the process proceeds back to step 142 in FIG. 10 to calculate the outputs of the remaining voices. After all the outputs of all the voices have been computed, the resulting sum of the voices represents one pulse code modulated data point of the final audio signal.

Thus, FM generator 70 processes all the audible operators recursively until all the operators, and thereby all the voices, have been processed to produce a single PCM data point. The PCM data point is written to a memory in step 175, referring back to FIG. 9. In the illustrated embodiment, the memory is a memory space (not shown) allocated within the memory of the processor. The stored information is accessed through a direct memory access routine.

The process of computing PCM data points is repeated until all of the determined amount of PCM data points necessary to fill memory space 31 has been computed, as shown in steps 177 and 180. The PCM data includes data for both left and right channels for stereo, and four channels if FM generator 70 is emulating an FM chip capable of quadraphonic stereo. After the last PCM data point has been computed and written to memory space 31, the FM generator 70 returns to step 112 and waits for the next interrupt.

The PCM data points are buffered in memory space 31. Memory 31 can be any type of suitable memory for buffering data By way of examples, memory 31 may be static RAM, dynamic RAM, or a FIFO type memory. In the illustrated embodiment, memory 31 is memory allocated in CPU 10 addressable through direct memory access (DMA). DMA allows FM generator 70 to write to memory 31 by keeping track of two pointers, a head and tail pointers, which also allows FM generator 70 to know how much unread memory space is available. The head pointer points to the oldest unread data, and the tail pointer points to the newest unread data.

Digital to analog converter 32 accesses memory 31 at its specific rate. When digital to analog converter 32 reads from memory 31 the head pointer is pointed to the next oldest unread data By determining the difference between the head and tail pointers, FM generator 70 knows where to insert the new data and exactly how much unread data is left in memory 31.

In another embodiment, digital to analog converter 32 may include a codec for converting the PCM data into a suitable data format for conversion into an analog signal. Digital to analog converter 32 converts the digital information into an analog audio signal.

In the illustrated embodiment, the analog audio signal is passed to an amplifier 33. The amplified signal is typically sent to speaker 34. In alternate embodiments, both amplifier 33 and speaker 34 may be located on sound card 20'.

As mentioned in the illustrated embodiment, an interrupt occurring at 10 ms intervals is preferred. However, the interrupt can occur at shorter intervals or up to about 20 milliseconds. The human ear typically cannot notice a delay of 20–30 milliseconds. Thus, as long as the interrupts occur more frequently than a noticeable delay, FM generator 70 can update faster than can be detected by the human ear.

However, at the same time, FM application 80 is writing audio data to the FM emulator 90 at a substantially continuous rate. The rate at which the FM application writes to the FM emulator 90 is typically slower than the rate at which FM generator 70 accesses the audio data from the FM emulator 90. Thus, in most instances FM generator 70 obtains the most current audio data information, and at worst continues to process the previous audio data information. Because of the latency in the human ear, this is acceptable.

Figure 12A:
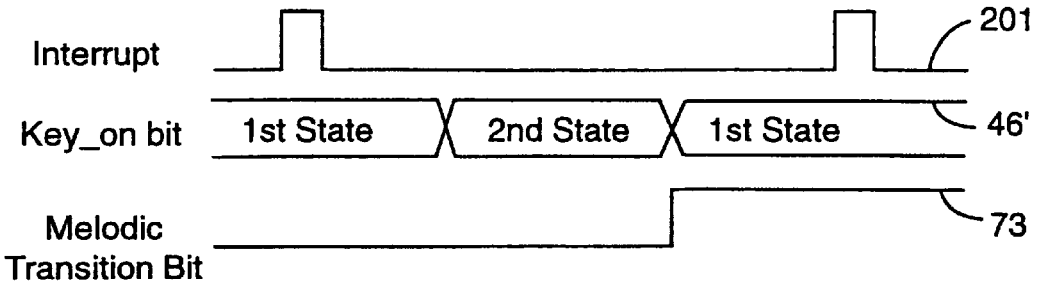
FIGS. 12*a* and 12*b* are exemplary timing diagrams illustrating the triggering of melodic and rhythmic transition bits in accordance with one embodiment of the present inventions.

However, there are situations where FM application 80 writes audio data to the FM emulator 90 at a rate faster than the interrupt rate of FM generator 70. FIG. 12*a* is a timing diagram illustrating such a situation. The interrupt signal 201 is illustrated as being set at a given interval. Between the intervals, key_on bit 46' for a particular voice may have been set during the first and second interrupts, but may have been reset between interrupts. The situation typically occurs when FM application 80 key offs a voice and immediately restarts the voice with new audio data information. However, the reverse may also occur—key_on bit transitioning from a reset state to a set and back to reset between interrupts. Without further information FM generator 70 may interpret the audio data information as requesting that the previous voice be sustained but new audio data information has been entered for the next voice, but not yet triggered.

In order to avoid the potential misinterpretation by FM generator 70, melodic and rhythmic transition bits 73 and 74 are utilized. Referring back to FIG. 7, key register 98 receives the transitions of key_on bits 46' and rhythm bits 55' from decoder 98. The transitions of the key_on bits 46' and rhythm bits 55' between intervals set the transition 73 and 74.

As seen in FIG. 12*a*, melodic transition bit 73 is set when the key_on bit 46' transitions from a first state to a second state and back to the first state between interrupts. Since the key_on bit 46' for a melodic voice shuts down both operators of the melodic voice, only one transition bit is needed for the melodic voice operator pair.

Figure 12B:
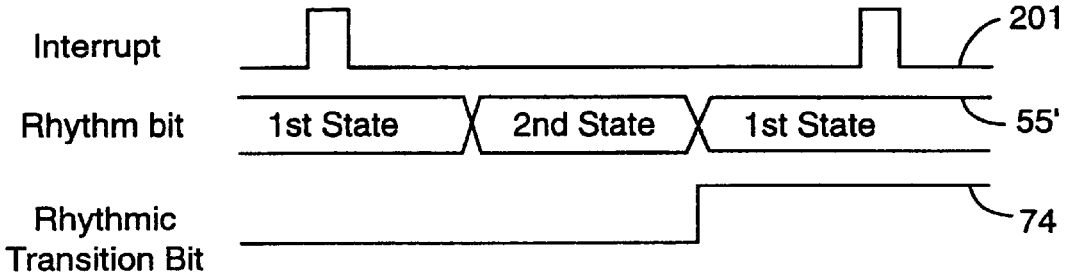

However, when rhythm mode is activated, only one or both operators may be active in a voice operator pair. FM application 80 may not necessarily use the key_on bit 46' to deactivate the single rhythm operator, choosing instead to reset the rhythm bit 55' for the particular rhythm operator. Thus, rhythmic transition bit 74 looks to the transition of the rhythm bit 55'. Referring to FIG. 12*b*, if the rhythm bit transitions from a first state to a second state and back to the first state between interrupts rhythmic transition bit is set.

Thus, rhythmic transition bits 74, in conjunction with melodic transition bits 73, allow for keying on and off at the operator level, as opposed to the voice level. The operator level key on states generated by hardware, allows the FM generator 70 to determine the key on states of each operator in a minimum number of cycles.

After FM generator 70 has read transition bits 73 and 74, they may then be reset by hardware within either key register decoder 98 or key off register 99. FM generator 70 will also play the appropriate sound, either starting a new voice (melodic or rhythmic) or playing a very short voice. While the production of a very short voice may seem inconsequential, a short voice with a long release may be audible, and thus necessary to include in the audio output.

In another embodiment, transition bits 73 and 74 are masked such that when FM generator 70 reads a key_on bit 46' for a particular voice it also reads the corresponding transition bits 73 and 74 of that voice. Having FM generator 70 read the key_on bits 46' and transition bits 73 and 74 simultaneously typically eliminates the chance that one bit will transition while the other bits are being read. Thus, the generation of melodic and rhythmic transition bits 73 and 74 indicative of the key on states of each operator facilitates the efficient reading of the key on states of the operators, without fear of transitioning states between multiple reads.

In another embodiment, where FM generator 70 is a $V_xD$ implemented on a CPU 10 running the Windows operating system, FM generator 70 may determine when FM application 80 has written to FM emulator 90. The Windows based operating system can detect a write to a specific peripheral card, in the illustrated embodiment, sound card 20'. The information may then be passed along to FM generator 70. Knowing when FM application 80 has written to the FM emulator 90, FM generator 70 can then follow up and immediately retrieve the audio data information from FM emulator 90. This ability may reduce the need for transition bits 73 and 74, however, operator level key control may still be desired.

Typically, the operations of the FM generator 70, to process the required data points, can be performed on today's computers while an FM application is concurrently running. As can be appreciated, the speed of the computer system will dictate whether FM emulation can be successfully performed. FM generator 70 is also typically small enough to fit within a small memory space. By way of example, FM generator 70 may fit within the memory of a computing device while the FM application is also running within the memory available to the computing device.

In the illustrated embodiment, an IBM PC compatible computer running on a DOS operating system requires that much of its conventional 640 kilobytes of memory be free for use by older programs. Typically, FM applications are such older programs requiring much of the 640 kilobytes of conventional memory. In the illustrated embodiment, FM generator 70 requires only a minimal amount of conventional memory space, thus allowing the older FM applications to run concurrently with FM generator 70.

Another major advantage of the present inventions is the drastic reduction of the complexity of sound card 20'. FM emulator 90 is typically small enough in gate size that it can be implemented in a programmable gate array. However, any suitable type of logic device may be used to implement FM emulator 90. By way of examples, custom ASICs, programmable logic devices and discrete logic may be utilized.

The present inventions also provide a versatile method of emulating a variety of FM sound chips. While the illustrated embodiment has focused on the emulation of an OPL3 FM sound chip, any suitable FM sound chip can be appropriately emulated. The present inventions contemplate providing an FM emulator that provides a facade to a FM application. The FM application provides the necessary audio data to produce an audio signal to the FM emulator, which is then passed on to the FM generator. The FM generator, implemented in a computer, computer system, or a processor or any other suitable computing device, performs the computations to derive the audio signal from the audio data. As can be appreciated, applying format specific changes to the FM emulator and the FM generator will allow them to emulate most, if not all, FM sound chips.

Finally, the present inventions provide additional flexibility in the number of operators and voices that may be utilized by an FM application. Prior art FM sound chips were limited to a limited number of arrangements of operators and voices. For example, the OPL3 FM sound chip could only provide four different combinations of four operator voices. The present inventions may be configured to allow all possible combinations of multi-operator voices, as well as single operator voices. Thus, current FM formats can be expanded to produce even richer audio, potentially achieving a level of fidelity approaching the more recent computer audio formats.

Although the foregoing invention has been described in some detail for purposes of clarity of understanding, it will be apparent that certain changes and modifications may be practiced within the scope of the appended claims. It should be noted that there are many alternative ways of implementing both the process and apparatus of the present invention. It is therefore intended that the following appended claims be interpreted as including all such alterations, permutations, and equivalents as fall within the spirit and scope of the present invention.

What is claimed is:

1. A method of emulating a frequency modulation sound chip comprising:

providing a frequency modulation emulator suitable to communicate with a computer system, the frequency modulation emulator providing an emulator addressable memory space, the emulator addressable memory space being substantially similar to an emulated addressable memory space on the emulated frequency modulation sound chip, the emulator addressable memory space being suitable for communication with a frequency modulation application implemented on the computer system, wherein the emulator chip is suitable to receive audio data through the addressable memory space from the frequency modulation application; and implementing a frequency modulation generator on the computer system, the frequency modulation generator accessing audio data from the frequency modulation emulator, whereby the frequency modulation generator receives audio data for processing in a manner that is substantially similar to the operation of the emulated frequency modulation sound chip, and the frequency modulation emulator provides communication with the frequency modulation application.

2. A method as recited in claim 1, wherein the frequency modulation emulator further includes:

a decoder in communication with the computer system, the decoder providing the addressable memory space, the decoder being capable of receiving the audio data from the frequency modulation application implemented on the computer system;

a memory in communication with the decoder and the frequency modulation generator, wherein the memory receives the audio data from the decoder and the memory provides the frequency modulation generator with access to the audio data.

3. A method as recited in claim 2, wherein the step of implementing the frequency modulation generator includes:

initializing the frequency modulation emulator including, initializing the memory, such that the memory is in a state substantially similar to a start up state of the emulated frequency modulation chip;

repeatedly retrieving the audio data from the memory at a predetermined interval of time; and generating the audio signal described by the audio data, the audio signal including a plurality of voices.

4. A method as recited in claim 2, wherein the audio data includes timer data and a version bit, and the frequency modulation generator chip further includes:

a variable length timer in communication with the decoder, the timer receiving the timer data from the frequency modulation application by way of the decoder, wherein the timer data determines the length of the variable length timer; and a status register in communication with the variable length timer and the frequency modulation application, the status register including, a timer flag, the variable length timer setting the timer flag when the timer has overflowed, and a version bit, the status register being masked in the addressable memory space such that the frequency modulation application can access the timer flag and the version bit from the status register through the addressable memory space, wherein the status register is in communication with the frequency modulation generator such that the frequency modulation generator is capable of setting the timer flag and the version bit.

5. A method as recited in claim 4, wherein the step of initializing the frequency modulation generator further includes initializing the timer to a predetermined state, and initializing the timer flag and the version bit of the status register.

6. A method as recited in claim 2, wherein the audio data includes mode data, and the frequency modulation emulator further includes:

a mode register in communication with the decoder and the frequency modulation generator, the mode register receiving the mode data from the frequency modulation application by way of the decoder, wherein the frequency modulation generator is capable of accessing the mode data from the mode register.

7. A method as recited in claim 6, wherein:

the step of initializing the frequency modulation generator further includes initializing the mode register to a predetermined state; and the step of implementing the frequency modulation generator further includes retrieving the mode data from the mode register, the frequency modulation generator operating in a one of a plurality of emulation modes based upon the value of the mode data.

8. A method as recited in claim 3, wherein the audio data includes key_on data, the frequency emulator chip further including:

a key decoder in communication with the decoder, the key decoder receiving the key_on data from the decoder; and a key register in communication with the key decoder and the frequency modulation generator, the key register including a melodic transition flag, wherein the key decoder sets the melodic transition flag when the key_on data transitions from a first key state to a second key state and back to the first key state within the predetermined interval of time, and the frequency modulation generator is capable of accessing the melodic transition flag.

9. A method as recited in claim 8, wherein:

the step of initializing the frequency modulation generator further includes initializing the key registers to a predetermined state; and the step of implementing the frequency modulation generator further includes, retrieving the melodic transition flag from the key register along with the audio data from the memory;

producing an associated audio signal corresponding to the key_on data and the melodic transition flag, and resetting the melodic transition flag if the melodic transition flag was set.

10. A method as recited in claim 8, wherein the audio data includes rhythm data, and the key register further includes a rhythmic transition flag, the key decoder receiving the rhythm data from the decoder, wherein the key decoder sets the rhythmic transition flag when the rhythm data transitions from a first rhythm state to a second rhythm state and back to the first rhythm state within the first predetermined interval of time, and the frequency modulation generator is capable of accessing the rhythmic transition flag.

11. A method as recited in claim 9, wherein the step of implementing the frequency modulation generator further includes:

retrieving the rhythmic transition flag from the key register along with the audio data from the memory;

producing an associated audio signal corresponding to the key_on data and the rhythmic transition flag; and resetting the rhythmic transition flag if the rhythmic transition flag was set.

12. A method as recited in claim 3, wherein the step of generating an audio signal includes:

determining a number of the plurality of voices of the audio signal described by the audio data;

providing a first voice, the voice having a first plurality of operators including a first carrier operator and a first modulator operator, the first voice being described by a first subset of the audio data associated with the first voice, wherein the first subset of the audio data describes a carrier operator output and a modulator operator output, the outputs including an envelope and a frequency components, the carrier operator output also including the incorporation of the modulator operator output, such that an output of the first voice may be the carrier operator output or the sum of the carrier and modulator outputs, as determined by the first subset of the audio data associated with the first voice, and repeating for the number of the plurality of voices described by the audio data;

determining if an output of an each of the first plurality of operators of the first voice is audible and repeating for the number of the plurality of voices;

discarding an inaudible operator of the first plurality of operators of the first voice, wherein the inaudible operator has an associated output that is inaudible, and repeating for the number of the plurality of voices;

generating the output of the each of the first plurality of operators of the first voice that has not been discarded, and repeating for the number of the plurality of voices;

generating the output of the first voice from the output of the each of the first plurality of operators that has not been discarded, and repeating for the number of the plurality of voices; and generating the audio signal from the outputs of the plurality of voices.

13. A method as recited in claim 1, wherein the computer system is an IBM PC compatible computer system, such that the frequency modulation generator is capable of being implemented within a conventional memory space of the IBM PC compatible computer system while also allowing the frequency modulation application to be concurrently implemented on the IBM PC compatible computer system.

14. A method of emulating a frequency modulation sound chip comprising:

providing a frequency modulation emulator in communication with a computer system, the frequency modulation emulator providing an emulator addressable memory space substantially similar to an emulated addressable memory space on the emulated frequency modulation sound chip, the frequency modulation emulator being suitable for communication with a frequency modulation application implemented on the computer system, wherein the emulator receives audio data through the addressable memory space from the frequency modulation application, the audio data including timer data, mode data, key_on data and rhythm data, the frequency modulation emulator including, a decoder in communication with the computer system, the decoder providing the addressable memory space capable of receiving the audio data from the frequency modulation application, a memory in communication with the decoder and a frequency modulation generator, wherein the memory receives the audio data from the decoder and the memory provides the frequency modulation generator with access to the audio data, a variable length timer in communication with the decoder, the timer receiving the timer data from the frequency modulation application by way of the decoder, wherein the timer data determines the length of the variable length timer, a status register in communication with the variable length timer and the frequency modulation application, the status register including, a timer flag, the variable length timer setting the timer flag when the timer has overflowed, and a version bit, the status register being masked in the addressable memory space such that the frequency modulation application can access the timer flag and the version bit from the status register through the addressable memory space, wherein the status register is in communication with the frequency modulation generator such that the frequency modulation generator is capable of setting the timer flag and the version bit, a mode register in communication with the decoder and the frequency modulation generator, the mode register receiving the mode data from the frequency modulation application by way of the decoder, wherein the frequency modulation generator is capable of accessing the mode data from the mode register, a key decoder in communication with the decoder, the key decoder receiving the key_on data from the decoder, and a key register in communication with the key decoder and the frequency modulation generator, the key register including a melodic transition flag and a rhythmic transition flag, wherein the key decoder sets the melodic transition flag when the key_on data transitions from a first key state to a second key state and back to the first key state within a first predetermined interval of time, and the key decoder sets the rhythmic transition flag when the rhythm data transitions from a first rhythm state to a second rhythm state and back to the first rhythm state within the first predetermined interval of time, and the frequency modulation generator is capable of accessing the melodic and rhythmic transition flags; and implementing the frequency modulation generator on the computer system, the frequency modulation generator accessing the audio data front, the frequency modulation emulator and processing the audio data to produce an audio signal, implementing the frequency modulation generator including, initializing the frequency modulation generator chip including, initializing the memory, such that the memory is in a state substantially similar to a start up state of the emulated frequency modulation chip, initializing the timer to a predetermined state, initializing the timer flag and the version bit of the status register, initializing the mode register to a predetermined state, initializing the key register to a predetermined state, retrieving the mode data from the mode register, the frequency modulation generator operating in a one of a plurality of emulation modes based upon the value of the mode data, repeatedly retrieving the audio data from the memory and the melodic and rhythmic transition bits from the status register at the first predetermined interval of time, generating the audio signal described by the audio data and the melodic and rhythmic transition flags, the audio signal including a plurality of voices, and resetting the melodic and rhythmic transition flags if the melodic and rhythmic transition flags were set, respectively.

15. A method as recited in claim 14, wherein the step of generating an audio signal includes:

determining a number of the plurality of voices of the audio signal described by the audio data;

providing a first voice, the voice having a first plurality of operators including a first carrier operator and a first modulator operator, the first voice being described by a first subset of the audio data associated with the first voice, wherein the first subset of the audio data describes a carrier operator output and a modulator operator output, the outputs including an envelope and a frequency components, the carrier operator output also including the incorporation of the modulator operator output, such that an output of the first voice may be the carrier operator output or the sum of the carrier and modulator outputs, as determined by the first subset of the audio data associated with the first voice, and repeating for the number of the plurality of voices described by the audio data;

determining if an output of an each of the first plurality of operators of the first voice is audible and repeating for the number of the plurality of voices;

discarding an inaudible operator of the first plurality of operators of the first voice, wherein the inaudible operator has an associated output that is inaudible, and repeating for the number of the plurality of voices;

generating the output of the each of the first plurality of operators of the first voice that has not been discarded, and repeating for the number of the plurality of voices;

generating the output of the first voice from the output of the each of the first plurality of operators that has not been discarded, and repeating for the number of the plurality of voices; and generating the audio signal from the outputs of the plurality of voices.

16. A frequency modulation emulator for use with a frequency modulation generator, the frequency modulation generator implemented on a computer system, for emulating a frequency modulation sound chip comprising:

a decoder in communication with the computer system, the decoder providing an emulator addressable memory space substantially similar to an emulated addressable memory space on the emulated frequency modulation sound chip and capable of receiving audio data from a frequency modulation application implemented on the computer system;

a memory in communication with the decoder and the frequency modulation generator, wherein the memory receives the audio data from the decoder and the memory allows the frequency modulation generator to access the audio data.

17. A frequency modulation emulator as recited in claim 16, wherein the audio data includes timer data, the frequency modulation emulator further comprising:

a variable length timer in communication with the decoder, the timer receiving the timer data from the from the frequency modulation application by way of the decoder, wherein the timer data determines the length of the variable length timer;

a status register in communication with the variable length timer and the frequency modulation application, the status register including a timer flag, the variable length timer setting the timer flag when the timer has overflowed, the status register being masked in the addressable memory space such that the frequency modulation application can access the timer flag from the status register through the addressable memory space.

18. A frequency modulation emulator as recited in claim 17, wherein the status register is in communication with the frequency modulation generator, and further includes a version bit, the frequency modulation generator capable of setting the value of the version bit and the timer flag, whereby the frequency modulation application is capable of accessing the version bit.

19. A frequency modulation emulator as recited in claim 16, wherein the audio data includes mode data, the frequency modulation emulator further comprising:

a mode register in communication with the decoder and the frequency modulation generator, the mode register receiving the mode data from the frequency modulation application by way of the decoder, wherein the frequency modulation generator is capable of accessing the mode data from the mole register.

20. A frequency modulation emulator as recited in claim 16, wherein the audio data includes key_on data, the frequency modulation generator further comprising:

a key decoder in communication with the decoder, the key decoder receiving the key_on data from the decoder; and a key register in communication with the key decoder and the frequency modulation generator, the key register including a melodic transition flag, wherein the key decoder sets the melodic transition flag when the key_on data transitions from a first key state to a second key state and back to the first key state within a first predetermined interval of time, and the frequency modulation generator is capable of accessing the melodic transition flag.

21. A frequency modulation emulator as recited in claim 20, wherein the audio data includes a rhythm data, and the key register further includes a rhythmic transition flag, the key decoder receiving the rhythm data from the decoder, wherein the key decoder sets the rhythmic transition flag when the rhythm data transitions from a first rhythm state to a second rhythm state and back to the first rhythm state within a second predetermined interval of time, and the frequency modulation generator is capable of accessing the melodic transition flag.

22. A frequency modulation emulator as recited in claim 21, wherein the first and second predetermined intervals of time are the same and is the amount of time between accesses by the frequency modulation generator to the memory.

23. A method of emulating a frequency modulation sound chip comprising:

receiving an instruction from a frequency modulation application implemented on a computer system to play an audio signal, the instruction including audio data describing the audio signal to be played, receiving the instruction being performed by a frequency modulation emulator;

storing the instruction in a memory of the frequency modulation emulator;

retrieving the instruction from the memory, retrieving the instruction being implemented by a frequency modulation generator implemented on the computer system; and generating the audio signal described by the first plurality of data, generating the audio signal being implemented by the frequency modulation generator.

24. A method of emulating a frequency modulation sound chip as recited in claim 23, wherein the first plurality of data includes a timer selection and a mode selection, the method further comprising:

providing a timing signal to the frequency modulation application associated with the timer selection, providing the timing signal being implemented by the frequency modulation emulator;

repeating the step of retrieving the instruction from the first memory at a predetermined interval of time; and determining a mode of operation associated with the mode selection, determining the mode being implemented by the frequency modulation generator.

25. A method as recited in claim 24, wherein the first plurality of data includes key_on data and rhythm data, the method further comprising:

generating a melodic transition flag when the key_on data transitions from a first key_on state to a second key_on state and back to the first key_on state within the predetermined interval of time;

generating a rhythmic transition flag when the rhythm data transitions from a first rhythmic state to a second rhythmic state and back to the first rhythmic state within the predetermined interval of time;

wherein the step of generating the audio signal further incorporates the melodic and rhythmic transition flags into the generation of the audio signal.

26. A frequency modulation generator for use with a frequency modulation emulator, the frequency modulation generator implemented on a computer system for emulating a frequency modulation sound chip, the frequency modulation generator arranged to configure the computer system to:

retrieve audio data from the frequency modulation emulator; and generate an audio signal, the audio signal being described by the audio data wherein the audio data includes a key on data and a rhythmic data;

repeatedly retrieve the audio data from the frequency modulation generator chip at a predetermined interval of time;

retrieve a melodic transition flag generated by the frequency modulation emulator along with the audio data, the melodic transition flag being set when the key on data transitions from a first key on state to a second key_on state and back to the first key_on state within the predetermined interval of time; and retrieve a rhythmic transition flag generated by the frequency modulation emulator along with the audio data, the rhythmic transition flag being set when the rhythm data transitions from a first rhythmic state to a second rhythmic state and back to the first rhythmic state within the predetermined interval of time;

such that the generation of the audio signal incorporates the key_on data, and the melodic and rhythmic flags.

27. A frequency modulation sound card for use with a frequency modulation generator, the frequency modulation generator being implemented on a computer system, the frequency modulation sound card comprising:

a decoder in communication with a computer system, the decoder providing an addressable memory space substantially similar to an emulated frequency modulation sound chip and capable of receiving audio data from a frequency modulation application implemented on the computer system; and a memory in communication with the decoder and the frequency modulation generator, wherein the memory receives the audio data from the decoder and the memory allows access to the audio data to the frequency modulation generator;

wherein frequency modulation generator is arranged to configure the computer system to retrieve audio data from the memory and generate an audio signal, the audio signal being described by the audio data.

* * * * *